US005236163A

United States Patent [19]

Valiulis

[11] Patent Number: 5,236,163

[45] Date of Patent: Aug. 17, 1993

[54] MERCHANDISE HANGER ASSEMBLY WITH SCANNER ARM

[75] Inventor: Stanley C. Valiulis, Rockford, Ill.

[73] Assignee: Southern Imperial, Inc., Rockford, Ill.

[21] Appl. No.: 831,948

[22] Filed: Feb. 6, 1992

[51] Int. Cl.[5] ..... E04G 3/00

[52] U.S. Cl. ..... 248/220.4; 211/57.1; 211/59.1

[58] Field of Search ..... 211/57.1, 59.1, 106; 248/220.2, 220.3, 220.4; 40/657

[56] References Cited

U.S. PATENT DOCUMENTS

| | | | |
|---|---|---|---|
| 3,245,547 | 4/1966 | Felkay | 248/220.4 X |
| 3,442,396 | 5/1969 | Cass | 248/220.3 |
| 3,481,481 | 12/1969 | Witek et al. | 248/220.4 X |
| 3,912,084 | 10/1975 | Valiulis | 211/57 |
| 4,027,799 | 6/1977 | Stucker | 248/220.3 X |
| 4,405,051 | 9/1983 | Thalenfield | 248/220.4 X |
| 4,452,360 | 6/1984 | Barnes | 211/59.1 |
| 4,560,062 | 12/1985 | Valiulis | 206/44 R |
| 4,850,557 | 7/1989 | Valiulis | 248/220.4 |
| 4,869,376 | 9/1989 | Valiulis et al. | 211/59.1 |
| 4,976,058 | 12/1990 | Valiulis | 248/220.4 X |

OTHER PUBLICATIONS

Trion Loop Hanger with Scanning Arm Promotional Literature, Jan. 1991.

*Primary Examiner*—David A. Scherbel
*Assistant Examiner*—Derek J. Berger
*Attorney, Agent, or Firm*—Leydig, Voit & Mayer

[57] ABSTRACT

A merchandise hanger assembly comprising a loop hook adapted to extend outwardly from a perforated panel and defined by first and second laterally spaced arms. A scanner arm includes a brace portion extending laterally across and welded to the inner ends of the hanger arms, an integral mid-portion extending outwardly above the hanger arms in laterally offset relation thereto, and an integral outer portion for supporting a merchandise tag.

2 Claims, 1 Drawing Sheet

MERCHANDISE HANGER ASSEMBLY WITH SCANNER ARM

TECHNICAL FIELD

This invention relates to an improved display hanger or "hook" of the type which is attached to a perforated panel, such as a Pegboard, and serves to hold and display retail merchandise.

BACKGROUND OF THE INVENTION

Basically, there are two different types of display hooks which presently are in wide use with perforated panels. The first is a standard single-arm wire hook of the type disclosed in U.S. Pat. No. 3,912,084 to S. Valiulis. Wire hooks of this type include a horizontally extending hanger arm for supporting merchandise through a hole perforated in the product packaging.

A second type of hook which presently is being widely used is a so-called "loop hook". Loop hooks are disclosed in U.S. Pat. No. 4,560,062 to S. Valiulis. Generally, they comprise a pair of horizontally spaced arms joined integrally at their outer ends and defining a U-shaped configuration when viewed from above.

Both single-arm and loop hooks may be provided with a so-called "scanner arm". Scanner arms typically include an arm which extends horizontally and supports a price tag, especially a price tag which may be "read" by an electronic scanning wand. An example of a single-arm hook with a scanning arm is shown in U.S. Pat. No. 4,452,360 to R. Barnes.

Loop hooks with a scanning arm are commercially available as well. In particular, prior art hooks have been fabricated from metal wire and have included a conventional loop as described above. A horizontally extending brace member is welded across the horizontally spaced wire arms near their inner ends. A scanner arm is welded to the brace member and extends therefrom generally parallel to and centered between the wire arms.

The advantages of loop hooks with braces are well known, as are the advantages of scanner arms. It will be appreciated, however, that retailers typically use large numbers of hooks and that demand for this product is extremely price sensitive. Accordingly, there is a continuing need to reduce the cost of manufacturing such hooks.

The general object of the subject invention, therefore, is to provide a sturdy loop hook with a scanner arm which is more easily, inexpensively, and reliably manufactured.

This object and other objects and advantages of the invention will be apparent to those skilled in the art upon reading the following detailed description and upon reference to the drawings.

SUMMARY OF THE INVENTION

In general, the primary object of the invention is achieved by fabricating a more or less conventional loop hook and then fabricating both a brace member and a scanner arm from a single piece of wire. In accordance therewith, the invention provides for a merchandise hanger assembly for use with perforated panels, which hanger assembly comprises:

(a) first and second horizontally spaced arms connected at their outer ends and defining a generally U-shaped configuration when viewed from above;

(b) means at the inner ends of the arms adapted to be inserted through holes in a perforated panel for holding the hanger assembly in outwardly extending relation to the perforated panel; and (c) a third arm comprising an inner portion which bridges the first and second arms in the vicinity of their inner ends and is connected thereto, a mid-portion which extends substantially parallel to the first and second arms and preferably in laterally offset relation thereto, and an outer portion which is adapted to carry means for displaying a merchandise tag.

DETAILED DESCRIPTION OF THE INVENTION

Figure 1:
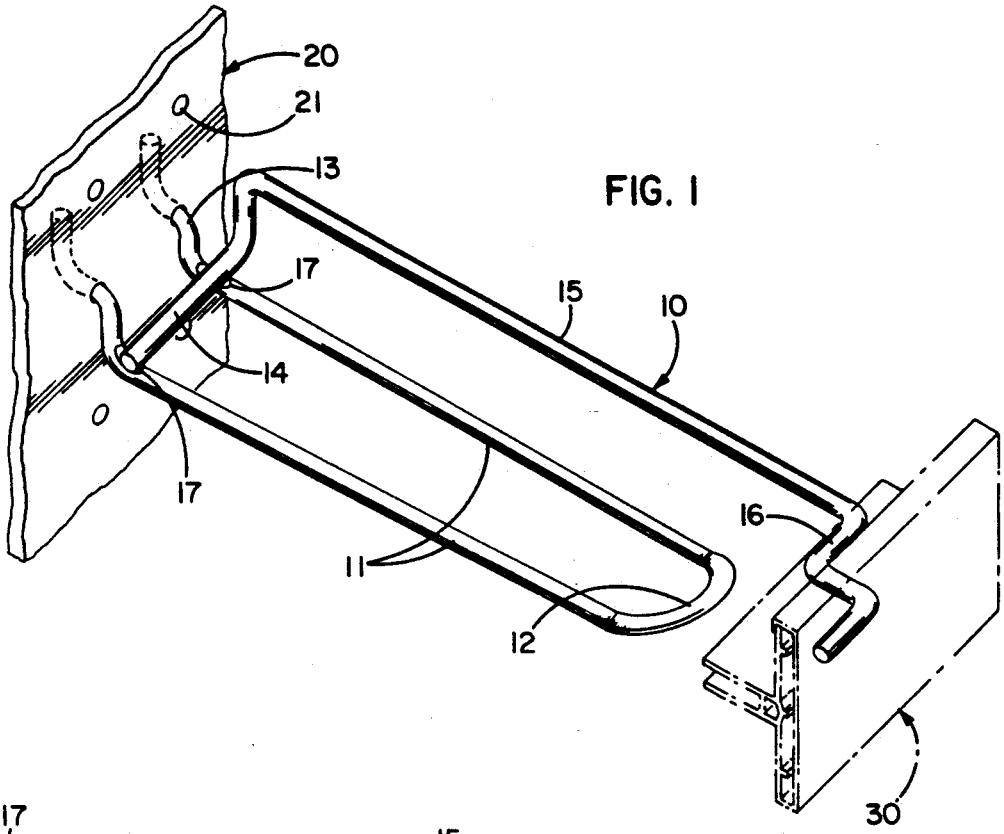
FIG. 1 is a perspective view of a preferred embodiment of a merchandise hanger assembly of the subject invention, the hanger assembly being shown attached to a perforated panel and having a plastic tag holder.

As best shown in FIG. 1, the merchandise hanger 10 of the subject invention is used with a display panel 20. The display panel 20 is of conventional construction and includes several vertically spaced rows of horizontally spaced holes 21 extending through the panel. Perforated panels of this type, commonly referred to as Pegboard-type panels, are widely available.

Figure 2:
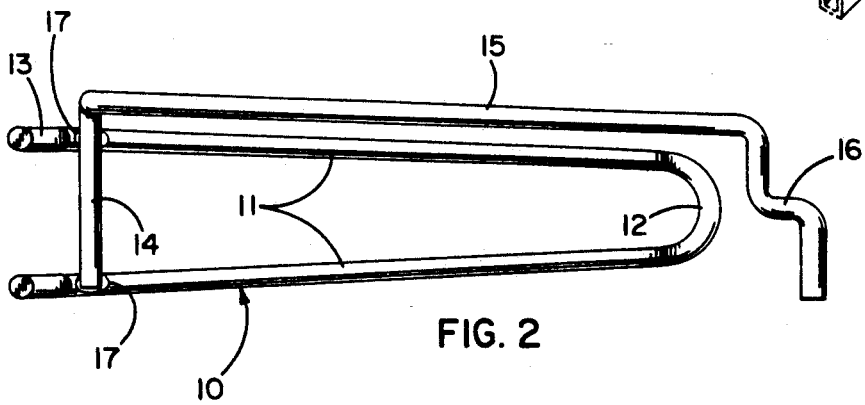
FIG. 2 is a top plan view of the hanger assembly shown in FIG 1.
Figure 3:
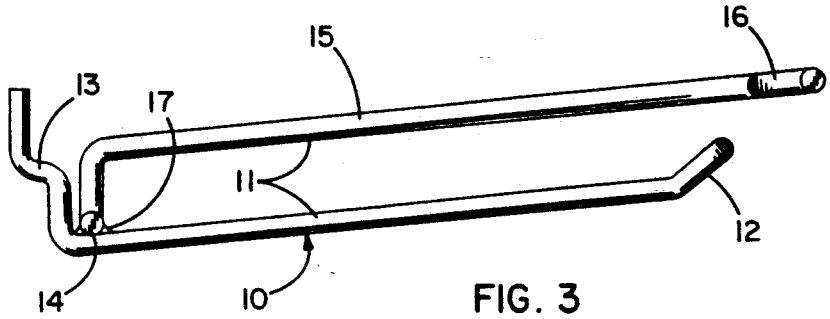
FIG. 3 is a side elevational view of the hanger assembly shown in FIG. 1.

The merchandise hanger assembly 10 generally includes a loop hook, a brace for the loop hook, and a scanning arm. In particular, the loop hook comprises a pair of horizontally spaced wire arms 11 (FIGS. 1–2) integrally joined to an outer wire bridge 12 and defining a U-shaped configuration when viewed from above. Formed integrally with the inner ends of the arms are two generally upright fingers or horns 13 (FIGS. 1 and 3). The horns are adapted to be inserted horizontally through two adjacent holes 21 of the panel 20 and then lock against the panel to hold the hanger 10 in outwardly extending relation from the panel.

Various types of merchandise, either packaged or unpackaged, may be hung from the loop hook and displayed in front of the panel. The extreme outer end portion of the loop hook is turned upwardly to help retain the merchandise on the arm.

The brace and scanner arm of the merchandise hanger assembly are integrally formed from a single piece of wire. More specifically, the inner portion 14 of the scanner arm bridges the horizontally spaced arms 11 near their inner ends and is connected thereto. This inner portion 14 of the scanner arm serves as a brace for the loop hook.

By way of a pair of 90° bends, offset 90° from each other, the mid-portion 15 of the scanner arm is made to extend substantially parallel to the horizontally spaced arms 11 in laterally offset relation thereto. The mid-portion of the scanner arm thus is offset laterally from the entire loop hook.

The end portion 16 of the scanner arm, as shown in FIG. 1, is adapted to permit the display of a price tag, especially one that may be read with an electric scanner. More specifically, FIG. 1 shows an extruded, transparent plastic holder 30 which is adapted to carry a price tag (not shown) printed with price, stock number, or other information relating to the merchandise on the arm. The outer portion 16 of the scanning arm is configured so that this particular type of plastic holder 30 may be clipped onto it, i.e., it has a series of three 90° bends. Other types of holders may be used and, therefore, the outer portion 16 may be configured in other ways compatible with different holders. Indeed, the precise manner in which the price tag is carried on the outer portion 16 of the scanning arm is a matter of convenience. Entirely different means may be used, such as welding or adhering a plate upon which tags may be hung or stuck.

The merchandise hanger assembly of the subject invention preferably is made from two pieces of wire, such as C1008 or C1010 grade steel wire having a diameter of from about 0.15 to about 0.25 inches. This type of wire, and other suitable wire is commercially available from a number of sources. The wire may be bent, shaped, and welded together by conventional tools and methods. It will be appreciated, however, that, as compared to the prior art, the merchandise hanger assembly of the subject invention requires less welding, and thus, is more cheaply, easily, and reliably manufactured.

That is, with prior art designs such as that discussed above, each end of the brace member must be welded across the arms of the loop hook. The scanning arm then is welded to the brace. A total of three welds is required. With the design of the subject invention, however, only two welds 17 are required. One weld is located between the inner end portion of one of the arms 11 and the free end portion of the brace 14 while the other weld is located between the inner end portion of the other arm and the opposite end portion of the brace. Manufacture is economized and the risk of defective welds is diminished. Yet, the novel hanger still has the advantage of being braced across the loop hook and is provided as well with a scanning arm.

If desired the hanger assembly may be made from other materials, such as molded acrylonitrile butyldiene styrene pieces which are ultrasonically welded together. The same advantages of having a reduced number of welds will be achieved.

While this invention has been disclosed and discussed primarily in terms of specific embodiments thereof, it is not intended to be limited thereto. Other modifications and embodiments will be apparent to those who work in the art.

I claim:

1. A merchandise hanger assembly fabricated from wire and comprising first and second horizontally spaced arms connected at their outer ends and defining a generally U-shaped configuration when viewed from above, means for attaching said first and second arms to a perforated panel, a brace member extending across and connected to said first and second arms, and a third arm located above and extending substantially parallel to said first and second arms and adapted to carry means for displaying a merchandise tag, said hanger assembly being characterized in that said brace member and said third arm are defined by a single piece of wire.

2. A merchandise hanger assembly comprising first and second laterally spaced and outwardly extending wire arms integrally joined at their outer ends and defining a generally U-shaped configuration when viewed from above, means adjacent the inner ends of said arms for attaching said arms to a perforated panel, a generally horizontal brace extending laterally across and welded to the inner ends of said arms, a scanner arm having an upright portion joined to one end of said brace and having an outwardly extending portion joined to the upper end of said upright portion, the outwardly extending portion of said scanner arm being located above and being offset laterally from both of said first and second arms, said outwardly extending portion of said scanner arm having a laterally extending outer portion for supporting a display tag, said brace and said scanner arm being defined by a single piece of wire.

* * * * *